United States Patent [19]

Hockett

[11] 4,139,970

[45] Feb. 20, 1979

[54] ABRASIVE CLEANING APPARATUS

[76] Inventor: Wayne B. Hockett, 1701 E. Sligh Ave., Tampa, Fla. 33605

[21] Appl. No.: 746,493

[22] Filed: Dec. 1, 1976

Related U.S. Application Data

[63] Continuation-in-part of Ser. No. 614,191, Sep. 17, 1975, Pat. No. 4,027,433.

[51] Int. Cl.[2] ..... B24C 3/06

[52] U.S. Cl. ..... 51/427; 51/429; 239/587

[58] Field of Search ..... 51/8 R, 8 HD, 427, 429; 239/450, 536, 587

[56] References Cited

U.S. PATENT DOCUMENTS

| | | | |
|---|---|---|---|
| 2,729,918 | 1/1956 | VanDenburgh | 51/429 |
| 2,763,964 | 9/1956 | Luce | 51/8 R |
| 2,836,013 | 5/1958 | Koenig | 51/427 |
| 3,016,201 | 1/1962 | Brogden | 239/176 X |
| 3,074,649 | 1/1963 | Atkinson | 239/587 X |
| 3,149,438 | 9/1964 | Morley | 51/8 HD |
| 3,604,627 | 9/1971 | Miscovich | 239/587 X |

*Primary Examiner*—Gary L. Smith

*Attorney, Agent, or Firm*—Stein & Frijouf

[57] ABSTRACT

An abrasive cleaning apparatus configured for use in combination with a mobile chassis comprising a base to fasten the abrasive cleaning apparatus to the mobile chassis, an adjustable nozzle support to operatively support a plurality of nozzles thereon, and an interconnecting support to connect the base with the nozzle support. The interconnecting support is rotatably attached to the base to permit the nozzle support to be rotated in the horizontal plane to position the nozzles horizontally relative to a work surface. The nozzle support is pivotally connected to the upper portion on the interconnecting support to permit the nozzle support to pivot in the vertical plane and thus position the nozzles vertically relative to the work surface. The nozzle support comprises a nozzle holder pivotally attached at the end thereof. The pivotal attachment of the nozzle holder permits angular adjustment of the nozzles relative to the work surface. The abrasive cleaning apparatus further comprises a conduit take-up disposed adjacent the nozzle support to control the position of the conduit which interconnects the nozzles with a fluid medium pressure source.

15 Claims, 3 Drawing Figures

ABRASIVE CLEANING APPARATUS

CROSS REFERENCE TO RELATED APPLICATION

This is a continuation-in-part application, Ser. No. 614,191, Filed Sept. 17, 1975, now U.S. Pat. No. 4,027,433.

BACKGROUND OF THE INVENTION

1. Field of the Invention

An abrasive cleaning apparatus having a horizontal positioning means and a vertical positioning means to permit movement of a plurality of nozzles both horizontally and vertically relative to a work surface.

2. Description of the Prior Art

Sand blasting of surfaces cleaned preparatory to painting and simply cleaning in the case of stone or brick walls is a common practice. Generally, this is accomplished by an operator positioned on a scaffold or other suitable support to manually manipulate at least one discharge nozzle. Obviously the presence of the operator in the work zone makes this an extremely dirty and hazardous occupation. Moreover, the limited volume of sand blasted against the surface by a single nozzle is very inefficient.

As a result, abrasive blast apparatus, particularly used for large surface areas may employ multiple rather than a single blast nozzle. The obvious advantage of this being a greatly increased blast pattern. Due to the increased weight and speed of operation, these nozzles are often mounted on movable carriages or platforms on which the operator rides. The platform is movable laterally and vertically along the area to be cleaned which results in significant labor saving devices.

Unfortunately, a number of difficulties have been experienced which hindered general acceptance and wide use for the multi-nozzle head. For example, many multi-nozzle heads are of a type in which the sand and air are delivered and mixed in a common reservoir from which jet streams are propelled simultaneously from the nozzles all of which communicate directly with the reservoir. In another configuration, the operator may be provided with two separate nozzles each having its own supply lines. In either of these arrangements, individual control of the nozzles is lacking to the extent that the blast stream from one nozzle cannot be cut off independently of the other. Such independent manipulations of the blast from the different nozzles is desirable in situations involving spots or areas which present difficult cleaning problems. The blast from one nozzle must work on this different area for a prolonged period, during which time the other blasts will be cutting away injuriously at the metal or surrounding areas.

Another difficulty with previous multi-blast carriage arrangements is that the units are very cumbersome and complex so as to be suitable only for special cleaning operations. Also many such multiple nozzle machines have lacked adequate flexibility of movement and could not be easily manipulated.

Once there is developed an efficient abrasive cleaning apparatus which is able to position the plurality of nozzles both horizontally and vertically relative to a work surface, it is still desirable that the nozzles be adjusted angularly relative to the work surface so that the most efficiency is attained by the blasts from the nozzles against the work surface.

Thus, there is a clear need for an efficient, flexible and easily moved multiple nozzle blasting apparatus.

SUMMARY OF THE INVENTION

This invention relates to an abrasive cleaning apparatus configured for use with a mobile platform or chassis such as a forklift or the like. More specifically, the abrasive cleaning apparatus comprises a base means including attachment means to fasten the abrasive cleaning apparatus on the mobile chassis, an adjustable nozzle support means to operatively support a plurality of nozzles thereon, and interconnecting support means to connect the base means with the nozzle support means.

The abrasive cleaning apparatus is configured for use in combination with a fluid medium pressure source to position a plurality of nozzles relative to a work surface wherein a plurality of conduit means interconnect the nozzles with the fluid medium pressure source. The interconnecting support means comprises a support frame having one or more frame members, a frame base and pivot member. The interconnecting support means is rotatably mounted on the base means by means of the pivot member to permit rotation of the interconnecting support means about the vertical axis of the pivot member. Since the nozzle support means is mounted on the upper portion of the interconnecting support means, the nozzle support means is also rotatable in the horizontal plane to position the plurality of nozzles horizontally relative to the work surface. to cooperatively form a horizontal positioning means with the interconnecting support means.

The nozzle support means comprises at least one support beam and a nozzle holder at the forward end thereof having a plurality of apertures to operatively support a corresponding plurality of nozzles. The support beam is pivotally mounted on the upper portion of the interconnecting support means to permit pivoting of the nozzle support means in the vertical plane so that the nozzles can be positioned vertically relative to the work surface. The pivotal connection of the support beam to the interconnecting support means, along with a first drive means mounted at the frame base, and first drive linkage interconnecting the first drive means with the support beam cooperatively form a first vertical adjustment means.

The nozzle holder is pivotally connected near the midpoint thereof to the support beam. A second drive means is mounted on the rear portion of the nozzle support means. A second drive linkage is pivotally connected to the upper portion of the nozzle holder at one end thereof and the second drive means at the opposite end thereof so that the second drive means moves the second drive linkage in a direction toward or away from the nozzle holder. The pivotal connections of the nozzle holder, the second drive means, and the second drive linkage cooperatively form a second vertical adjustment means to adjust the angular position of the nozzles relative to the work surface.

The abrasive cleaning apparatus further comprises a conduit take-up means to control the position of the conduit means relative to the abrasive cleaning apparatus during the operation thereof. The conduit take-up means has at least one pair of substantially parallel rollers to take-up or pay out slack during operation of the second vertical adjustment means. The pair of rollers comprises a driver roller driven by a take-up means and an idler roller.

During the operation of the second vertical adjustment means, the upper section of the nozzle holder is moved in a direction either toward or away from the conduit take-up means while the lower portion is moved in the opposite direction. Thus, while one section requires slack to be paid-out, the other section requires slack to be taken-up. Thus, in the preferred embodiment of this invention, the conduit take-up means includes a first pair of rollers to partially engage the conduit means which interconnect the nozzles disposed on the upper section of the nozzle holder with the fluid medium pressure source and a second pair of rollers to at least partially engage the conduit means which interconnect the nozzles disposed on the lower sectionoof the nozzle holder with the fluid medium pressure source.

In operation, the operator stands or sits in a seat on the platform adjacent the adjustable nozzle support means. As can be readily understood, the plurality of nozzles is coupled with a remote supply source through the conduit means. For example, the remote supply source may comprise a sand hopper which also incorporates an appropriate compressed air supply to forcefully transport and drive the abrasive from the nozzles. In a manner which will be understood, a supply of compressed air is directed along with the sand into flexible sand conduits for transporting the san through these conduits. In addition, compressed air may also be directed into flexible air conduits. This separate supply of air under pressure eventually being directed into a mixing reservoir within the blast nozzles to and against the work. The manner in which the air and sand is mixed in the nozzle is of no particular concern. The nozzle structure of the present mechanism itself can be on any appropriate conventional configuration.

To adjust the abrasive cleaning apparatus while cleaning the work surface, the operator rotates the nozzle support means about the vertical axis of the pivot member to position the plurality of nozzles horizontally relative to the work surface. Vertical positioning of the nozzles relative to the work surface is accomplished by operation of the first drive means to pivot the nozzle support means in the aforedescribed vertical plane. The operator then re-adjusts the angular position of the nozzles relative to the work surface by operating the second drive means to pivot the nozzle holder as aforedescribed. In conjunction therewith, the operator operates the first and second take-up drive means to take-up and pay-out slack in the conduit means as is necessary.

In this manner, the operator is able to clean an enlarged work surface through the use of multiple nozzles without the necessity of supporting the nozzles or air and abrasive supply conduits. The mobile chassis is then moved to an adjacent work surface until the entire area is cleaned.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and the objects of the invention, reference should be had to the following detailed descriptions taken in connection with the accompanying drawints in which.

Similar reference characters refer to similar parts throughout the several views of the drawings.

DETAILED DESCRIPTION OF THE PREFERRED EMBODIMENT

Figure 1:
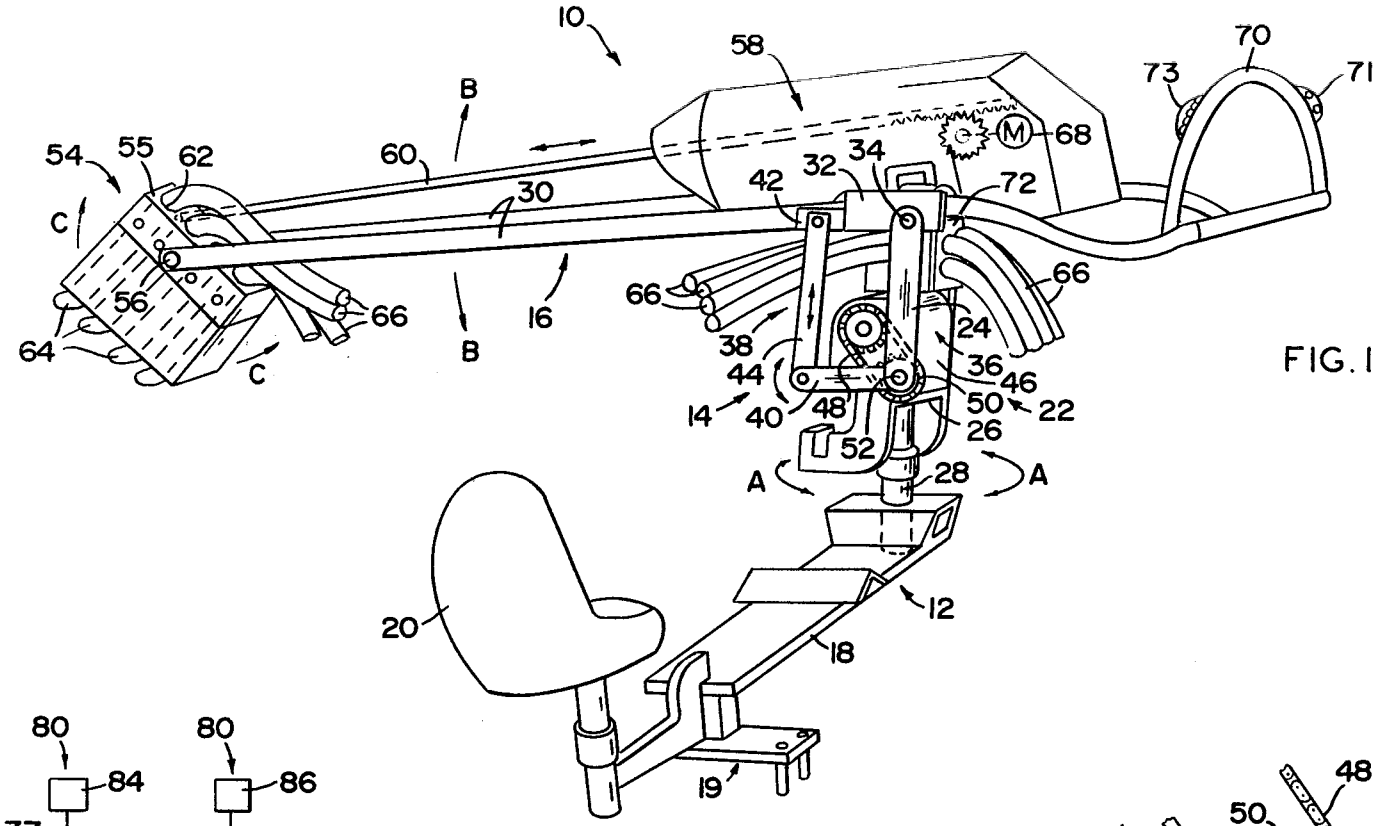
FIG. 1 is a perspective side view of the abrasive cleaning apparatus.
Figure 3:
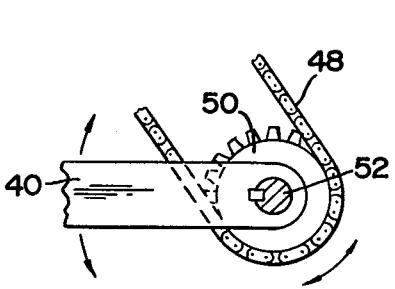
FIG. 3 is a detailed view of the vertical positioning means of FIG. 1.
Figure 2:
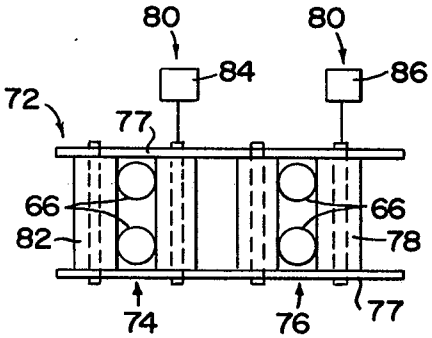
FIG. 2 is a detailed view of the conduit take-up means.

As best shown in FIG. 1, the present invention comprises an abrasive cleaning apparatus generally indicated as 10 configured for use in combination with a fluid medium pressure source to position a plurality of nozzles relative to a work surface for cleaning large work surfaces. The abrasive cleaning apparatus 10 comprises a base means 12, interconnecting support means 14 and an adjustable nozzle support means 16 to operatively support a plurality of nozzles thereon.

As shown in FIG. 1, the base means 12 comprises a substantially flat base plate 18. A seat 20 is stationed on the rear portion of the base plate 18 from which the operator controls the abrasive cleaning apparatus 10. The base plate 18 is mounted on a mobile chassis or other suitable platform or support means (not shown) by suitable attachment means 19 so that the abrasive cleaning apparatus 10 can be easily transported from one work area to another. The interconnecting support means 14 comprises a support frame 22 including a pair of substantially vertical frame members 24 fixedly attached to a base plate 26 by pivot member 28 to form a horizontal positioning means to permit rotational adjustment of the nozzle support means 16 as hereinafter described about the vertical axis of the support frame 22 as shown by arrow A—A.

The nozzle support means 16 includes a pair of support beams 30 and a hub 32 therebelow and fixedly attached thereto. The hub 32 is pivotally attached to the upper portion of the frame members 24 of the support frame 22 by means of pivot member 34 to permit adjustment of the nozzle support means 16 in the vertical plane about the axis of the pivot member 34.

A first drive means 36 is mounted on the frame base 26. A first drive linkage 38 comprising a first and second horizontal link 40 and 42 respectively and vertical link 44 interconnects the first drive means 36 with the support beam 30. The first drive means 36, first drive linkage 38 and the pivotal attachment of the support beam 30 to the support frame 22 by pivot member 34 cooperatively form a first vertical adjustment means. The first drive means 36 comprises a reversible motor 46 operable in a first and second direction operatively coupled to the first horizontal link 40 by means of a chain 48 and sprocket 50. The first horizontal link 40 is fixedly coupled to the sprocket 50 through shaft 52 at one end and pivotally connected to the lower portion of the vertical link 44 at the other end. The upper portion of the vertical link 44 is pivotally connected to one end of the second horizontal link 42 while the opposite end of the second horizontal link 42 is fixedly attached to the nozzle support means 16. Thus the first drive linkage 38 provides a sufficient moment for the force exerted by the first drive means 36 to rotate the nozzle support means 16 in a vertical plane about the axis of the pivot member 34 as shown by arrow B—B. More particularly, during operation, the first drive means 36 rotates the first horizontal link 40 upwardly so that the outer end thereof is moved vertically. This results in vertical movement of the vertical link 44 and the resultant rotation of the nozzle support means 16 in the vertical plane through the second horizontal link 42.

The nozzle support means 16 further comprises a nozzle holder 54 pivotally connected at the forward portion of the pair of support beams 30 on shaft 56, a second drive means 58 mounted at the rear portion thereof, and a second drive linkage 60 operatively interconnecting the nozzle holder 54 with the second drive means 58. The nozzle holder 54 includes a substantially flat plate 55 pivotally connected substantially near the midpoint thereof to the forward portions of the pair of support beams 30. The substantially flat plate 55 includes a plurality of apertures 62 formed therein, each of which operatively supports a corresponding nozzle 64. Hoses or other conduit means 66 interconnect each nozzle 64 with the fluid medium pressure source of supply (not shown). The nozzle holder 54 pivots in the vertical plane about the axis of shaft 56 as shown by arrow C—C to allow angular displacement of the nozzles 64 vertically relative to the work surface.

The forward portion of the second drive linkage 60 is pivotally attached to the upper portion of the nozzle holder 54 resulting in a moment between the point of attachment of the second drive linkage 60 and the shaft 56 when force is applied moving the second drive linkage 60 in a direction toward or away from the nozzle holder 54 causing the nozzle holder 54 to pivot about the horizontal axis of the shaft 56. That force is applied by the second drive means 58 comprising a reversible motor 68 or other commonly used drive means operable in a first and second direction. The second drive means 58 and the second drive linkage 60 together with the pivotal attachment of the nozzle holder 54 to the second drive linkage 60 and the support beams 30 cooperatively form a second vertical adjustment means. The first and second vertical adjustment means cooperatively form a vertical positioning means.

The second drive means 58 and first and second control means 71 and 73 respectively for the first and second drive means 36 and 58 respectively are mounted on a collar 70 near the rear portion of the nozzle support means 16 to position the control means 71 and 73 within convenient reach of the operator. In addition to effective vertical displacement of the nozzles 64 relative to the work surface by means of the controls the operator is able to effect horizontal displacement by means of the horizontal positioning means by manually applying lateral pressure at the rear portion of the nozzle support means 16 thus rotating the support frame 22.

Adjacent the hub 32 at the pivot point of the first vertical adjustment means is a conduit take-up means 72 which guides the hoses 66 to the nozzles 64 as they are adjusted and positioned relative to the work surface. The position of the conduit take-up means 72 adjacent the hub 32 prevents the hoses 66 from becoming entangled with the various moving positioning mechanisms during operation. The conduit take-up means 72 comprises a first and second pair of substantially parallel rollers 74 and 76 respectively disposed to partially engage each hose 66 by the passing of the hose 66 between each pair of rollers 74 and 76 respectively. The conduit take-up means 72 further includes guides 77 at the ends of each pair of rollers 74 and 76 respectively to prevent disengagement of hoses 66 therewith. Each pair of rollers 74 and 76 respectively comprises a drive roller 78 driven by a reversible take-up drive means 80 operable in a first and second direction by second control means 73 and an idler roller 82.

As shown in the description and drawings, as the nozzle holder 54 is pivoted by means of the second vertical adjustment means, either the upper section or the lower section of the nozzle holder 54 with its corresponding nozzles 64 and hoses 66 is moved further from the conduit take-up means 72 requiring additional hose length. The other section is moved closer to the conduit take-up means 72 requiring hose slack to be taken up.

The first pair of rollers 74 driven by a first take-up drive means 84 is disposed to partially engage the hoses 66 leading to the nozzles 64 on the lower section of the nozzle holder 54. The second pair of roller 76 is driven by a second take-up drive means 86 and is disposed to partially engage the hoses 66 leading to the nozzles 64 on the upper section of the nozzle holder 54.

The controls 73 for the first and second take-up drive means 84 and 86 respectively may be synchronized with the second drive means 58 so that as take-up drive means 84 or 86 is letting slack out, the other take-up drive means 84 or 86 is taking slack in. Thus as the second drive means 58 repositions the nozzles angularly with respect to the work surface, the interconnected and synchronized controls operate the first and second take-up drive means 84 and 86 respectively to let out hose or take in slack simultaneously and automatically as is necessary.

In operation, the operator stands or sits on the seat 20. The conduit means or hoses 66 couple the nozzles 64 to a remote supply sources. For example, the remote supply source may comprise a sand hopper which also incorporates an appropriate compressed air supply to forcefully transport and drive the abrasive from the nozzles 64. In a manner which will be understood, a supply of compressed air is directed along with the sand into flexible sand conduits conduits for transporting the sand through these conduits. In addition, compressed air may also be directed into flexible air conduits. This separate supply of air under pressure is eventually directed into a mixing reservoir within the blast nozzles 64 to and against the work surface. The manner in which the air and sand is mixed in the nozzles is of no particular concern. The nozzle structure 64 of the present mechanism itself can be of any appropriate conventional configuration.

To adjust the abrasive cleaning apparatus 10, the horizontal position of the nozzles 64 relative to the work surface is adjusted by means of the horizontal positioning means as previously described. The vertical position of the nozzles 64 relative to the work surface is then adjusted by means of the first vertical adjustment means as previously described. To compensate for the resultant vertical angular displacement of the nozzles 64, the nozzles 64 are repositioned angularly relative to the work surface by means of the second vertical adjustment means as previously described.

The operator then cleans the work surface, manipulating the abrasive cleaning apparatus 10 by operating the first and second vertical adjustment means in the vertical plane relative to the work surface and rotating the horizontal positioning means in a horizontal plane relative to the work surface. In this manner, the operator is able to clean an enlarged work surface through the use of multiple nozzles without the necessity of supporting the nozzles or air and abrasive supply conduits. The mobile chassis is then moved to an adjacent work surface until the entire area is cleaned.

In this manner, an efficient and reliable sand blasting apparatus is provided.

It will thus be seen that the objects set forth above, among those made apparent from the preceding description, are efficiently attained, and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which as a matter of language, might be said to fall therebetween.

Now that the invention has been described, what is claimed is:

1. An apparatus for cleaning a work surface with an abrasive under fluid pressure from an abrasive and fluid pressure source, the apparatus adapted to be readily elevated on a mobile lifting platform, comprising in combination:

a base for mounting to the mobile lifting platform;

operator receiving means connected to said base enabling an operator to control the apparatus from an elevated position on the mobile lifting platform;

a plurality of nozzles;

a plural nozzle support for receiving said plurality of nozzles in a close relationship to form a plural nozzle array;

plural support beams;

angular positioning means for rotatably mounting said plural nozzle support to said plural support beams to position said plurality of nozzles in an angular direction relative to the work surface;

a collar secured in relation to said plural support beams enabling the operator to direct said plurality of nozzles at the work surface when the operator is positioned on said operator receiving means;

horizontal positioning means for rotatably mounting said plural support beams relative to said base to position said plurality of nozzles in a horizontal plane relative to the work surface upon movement of said collar;

vertical positioning means for rotatably mounting said plural support beams relative to said horizontal positioning means to position said plurality of nozzles in a vertical plane relative to the work surface; and a plurality of substantially parallel conduits for respectively connecting said plurality of nozzles to the abrasive and fluid pressure source with said plurality of conduits extending as a unit between said plural support beams and being immediately adjacent the rotational axis of said vertical positioning means.

2. The apparatus of claim 1 further including a conduit take-up means to take-up slack in said conduits.

3. The apparatus of claim 2 wherein said conduit take-up means is disposed adjacent said vertical positioning means.

4. The apparatus of claim 3 wherein said conduit take-up means comprises at least one pair of spaced rollers which engage said conduits therebetween and drive means for one of said rollers.

5. An apparatus as set forth in claim 1, wherein the rotational axis of said horizontal positioned means is located between said plural nozzle support and said collar.

6. An apparatus as set forth in claim 1, wherein said horizontal positioning means comprises a first rotatable shaft extending vertically from said base for rotatable mounting said plural support beams.

7. An apparatus as set forth in claim 6, wherein said vertical positioning means comprises a second rotatable shaft extending horizontally and mounted immediately adjacent said horizontally positioning means and in perpendicular relationship thereto; and motor means mounted on said horizontal positioning means for adjusting the vertical position of said plurality of nozzles relative to the work surface.

8. An apparatus as set forth in claim 7, wherein said angular position means comprises a third rotatable shaft mounted at terminal ends of plural support means;

said first and second rotatable shafts being located between said third rotation shaft and said collar; and motor means mounted immediately adjacent said second rotational axis for control by the angular position of said plurality of nozzles.

9. An apparatus as set forth in claim 8, wherein said plurality of conduit extends as a unit immediately adjacent said third rotational axis.

10. An apparatus as set forth in claim 9, wherein said plurality of conduits extend through said third rotational axis.

11. An apparatus as set forth in claim 10, wherein said third rotational axis comprises plural third shafts for pivoting said plural nozzle support relative to said plural support beams respectively.

12. An apparatus as set forth in claim 11, wherein said collar enables the operator to manually position said plural support beams in a horizontal position from said operator receiving means.

13. An apparatus as set forth in claim 12 wherein said operator receiving means includes a seat.

14. An apparatus for cleaning a work surface with an abrasive under fluid pressure from an abrasive and fluid pressure source, the apparatus adapted to be readily elevated on a mobile lifting platform, comprising in combination:

a base for mounting to the mobile lifting platform;

operator receiving means connected to said base enabling an operator to control the apparatus from an elevated position on the mobile lifting platfrom;

nozzle means;

a nozzle support for receiving said nozzle means;

plural support beams;

angular positioning means for rotatably mounting opposed sides of said nozzle support to said plural support beams to position said nozzle means in an angular direction relative to the work surface;

a collar secured in relation to said plural support beams enabling the operator to direct said nozzle means at the work surface when the operator is positioned on said operator receiving means;

horizontal positioning means for rotatably mounting said plural support beams relative to said base to position said nozzle means in a horizontal plane relative to the work surface upon movement of said collar;

vertical positioning means for rotatably mounting said plural support beams relative to said horizontal positioning means to position said nozzle means in a vertical plane relative to the work surface; and a plurality of substantially parallel conduits for respectively connecting said nozzle means to the abrasive and fluid pressure source with said plurality of conduits extending as a unit between said plural support beams and being immediately adjacent the rotational axis of said vertical positioning means.

15. An apparatus for cleaning a work surface with an abrasive under fluid pressure from an abrasive and fluid pressure source, the apparatus adapted to be readily elevated on a mobile lifting platform, comprising in combination:

a base for mounting to the mobile lifting platform;

operator receiving means connected to said base enabling an operator to control the apparatus from an elevated position on the mobile lifting platform;

nozzle means;

a nozzle support for receiving said nozzle means;

support beam means;

angular positioning means for rotatably mounting said nozzle support to said support beam means to position said nozzle means in an angular direction relative to the work surface;

a collar secured in relation to said plural support beams enabling the operator to manually direct said nozzle means at the work surface when the operator is positioned on said operator receiving means;

horizontal positioning means for rotatably mounting said support beam means relative to said base to position said nozzle means in a horizontal plane relative to the work surface upon movement of said collar;

said horizontal positioning means comprising a vertical shaft located between said nozzle support means and said collar;

vertical positioning means for rotatably mounting said support beam means relative to said horizontal positioning means to position said nozzle means in a vertical plane relative to the work surface; and a plurality of substantially parallel conduits for respectively connecting said nozzle means to the abrasive and fluid pressure source with said plurality of conduits extending as a unit along said support beam means and being immediately adjacent the rotational axis of said vertical positioning means.

* * * * *